US010684007B2

(12) United States Patent
Filippi et al.

(10) Patent No.: US 10,684,007 B2
(45) Date of Patent: Jun. 16, 2020

(54) SHELL-AND-TUBE APPARATUS FOR HEAT RECOVERY FROM A HOT PROCESS STREAM

(71) Applicant: Casale SA, Lugano (CH)

(72) Inventors: Ermanno Filippi, Castagnola (CH); Luca Redaelli, Drezzo (IT)

(73) Assignee: Casale SA, Lugano (CH)

( * ) Notice: Subject to any disclaimer, the term of this patent is extended or adjusted under 35 U.S.C. 154(b) by 0 days.

(21) Appl. No.: 14/899,333

(22) PCT Filed: Aug. 7, 2014

(86) PCT No.: PCT/EP2014/067023
§ 371 (c)(1),
(2) Date: Dec. 17, 2015

(87) PCT Pub. No.: WO2015/028277
PCT Pub. Date: Mar. 5, 2015

(65) Prior Publication Data

US 2016/0161106 A1 Jun. 9, 2016

(30) Foreign Application Priority Data

Aug. 29, 2013 (EP) ..... 13182293

(51) Int. Cl.
*F22B 1/18* (2006.01)
*F22B 37/26* (2006.01)
(Continued)

(52) U.S. Cl.
CPC ..... *F22B 1/1884* (2013.01); *F22B 1/1838* (2013.01); *F22B 21/02* (2013.01);
(Continued)

(58) Field of Classification Search
CPC ..... F22B 1/1838; F22B 1/1884; F22B 21/02; F22B 21/30; F22B 35/007; F22B 37/26
(Continued)

(56) References Cited

U.S. PATENT DOCUMENTS 2,373,564 A * 4/1945 Huff ..... F22B 1/1869 122/34
2,552,505 A 5/1951 Patterson
(Continued)

FOREIGN PATENT DOCUMENTS

EP 155735 9/1985
EP 0 848 207 A2 6/1998
(Continued)

OTHER PUBLICATIONS

International Search Report issued in connection with PCT/EP2014/067023.
(Continued)

*Primary Examiner* — Steven B McAllister
*Assistant Examiner* — Benjamin W Johnson
(74) *Attorney, Agent, or Firm* — Akerman LLP

(57) ABSTRACT

A shell-and-tube apparatus (1), suitable for use as a waste heat boiler, comprising a vessel with an exchanging section (2) and a separating section (3), wherein: said exchanging section (2) contains a bundle of U-tubes (4) fed with an evaporable liquid medium such as water (W) and exposed to a hot gas (G) flowing in a hot chamber around said tubes, so that said medium is partially evaporated in the tubes while recovering heat from hot gas flowing in the hot chamber (7); said separating section (3) comprises a collection chamber (16) in communication with outlet of the tubes (4) to receive the partially evaporated medium leaving the tubes; said separating section (3) is arranged to provide separation of vapour fraction and liquid fraction from the partially evapo-
(Continued)

rated medium at least partially by gravity; the apparatus also comprises means for controlling the liquid level in the collection chamber and for a partial recycle of the non-evaporated liquid.

11 Claims, 2 Drawing Sheets

(51) Int. Cl.
*F22B 21/02* (2006.01)
*F22B 21/30* (2006.01)
*F22B 35/00* (2006.01)

(52) U.S. Cl.
CPC ..... *F22B 21/30* (2013.01); *F22B 35/007* (2013.01); *F22B 37/26* (2013.01)

(58) Field of Classification Search
USPC ..... 122/7 R, 9; 422/198; 165/157, 158, 159, 165/160, 161, 174
See application file for complete search history.

(56) References Cited

U.S. PATENT DOCUMENTS 3,267,907 A * 8/1966 Glausser ..... F22B 1/1823 122/34
3,575,236 A 4/1971 Romanos
4,789,028 A 12/1988 Gowda et al.
4,967,699 A 11/1990 Hannerz
5,497,827 A 3/1996 Comic
5,767,313 A 6/1998 Jonckers
6,105,538 A * 8/2000 Aaltonen ..... F22B 1/1807 122/367.1
2004/0149239 A1 8/2004 Franke et al.
2007/0283907 A1 * 12/2007 Brinkmann ..... F22B 1/1884 122/460
2011/0083619 A1 * 4/2011 Master ..... F22B 1/16 122/32
2012/0148456 A1 6/2012 Filippi et al.

FOREIGN PATENT DOCUMENTS

GB 1 549 128 A 7/1979
WO WO 2011/093163 * 8/2011

OTHER PUBLICATIONS

International Preliminary Report on Patentability issued in connection with PCT/EP2014/067023.
Bothamley, Mark et al., Gas/Liquid Separators Quantifying Separation Performance, Oil and Gas Facilities, pp. 21-29, Aug. 2013.
Bothamley, Mark et al., Gas/liquid Separators: Quantifying Separation Performance—Part 1, vol. 2, issue 4, Jul. 22, 2013.
Rayaprolu, Kumar, Boilers: A Practical Reference, pp. 119-122, Oct. 26, 2012.
Stankiewicz, Andrezej et al., Process Intensification: Transforming Chemical Engineering, Process Design Trends, Chemical Engineering Progress, pp. 22-34, Jan. 2000.
Hawrelak, R.A., Vapor-Liquid Separator Design, Presented to CBE 497, Jan. 15, 2002.
"Steam its generation and use," 41st ed., pp. 5-13-15, 2005, published by The Babcock & Wilcox Company, Barberton, OH.
Notten, Giel, "Application of duplex stainless steel in the chemical process industry," Stainless Steel World, Duplex Stainless Steels 97, pp. 9-16.
Wikipedia "Erosionskorrosion" (https://de.wikipedia.org/wiki/Erosionskorrosion).

* cited by examiner

SHELL-AND-TUBE APPARATUS FOR HEAT RECOVERY FROM A HOT PROCESS STREAM

This application is a national phase of PCT/EP2014/067023, filed Aug. 7, 2014, and claims priority to EP 13182293.4, filed Aug. 29, 2013, the entire contents of both of which are hereby incorporated by reference.

FIELD OF APPLICATION

The invention relates to a shell-and-tube heat exchanger suitable for recovering heat from a process stream by evaporating a medium such as water. Such kind of a heat exchanger is commonly referred to as waste heat boiler (WHB).

PRIOR ART

A common need in chemical and petrochemical plants is to recover heat from a hot gas, such as the effluent of a combustion process or of a strongly exothermal reaction. Heat is normally recovered by evaporation of water and production of hot steam at a suitable pressure; the steam can be used internally in the process, where appropriate, to produce power or to drive an auxiliary device such as a compressor.

Vertical shell-and-tube steam boilers are widely used in the art to meet this need. In a typical prior-art vertical steam boiler, for example, the hot gas flows in a bundle of U-tubes arranged upward and connected to a tube sheet at the bottom; evaporation of water takes place in the shell side, which features an integrated steam drum for steam separation.

This design is relatively compact and requires no external steam drum; however, it is exposed to problems of corrosion, mainly caused by deposition of water-suspended solids outside the tubes and on the tube sheet. Further to the natural deposition by gravity, it has been noted that deposition of water-suspended solids is caused by the non-uniform distribution of water in the shell side. A higher deposition of solids has been observed in the regions of the shell side where the water feeding is more difficult and evaporation is stronger, with a possible occurrence of dry out. The term of dry out denotes a departure from nucleate boiling and sudden decrease of the heat exchange coefficient, which may also cause overheating of tubes. A further problem is given by deposit and oxidation which may occur during fabrication, and cannot be removed by the final user, due to inaccessibility of the area.

Another drawback of this design is due to the fact that when the hot gas enters the tubes, the first part of the tubes inside the tubesheet is not cooled by the evaporating medium and, therefore, is much hotter than the part of the tubes submerged in the evaporating media. When the inlet gas temperature is too high for the tube material, or above a limit that will induce corrosion in the tube material, a special design is needed for the inlet part of tubes. Said special design can involve internal protective ferrules, joining the tube to tubesheet on the back side, protective feature for the tubesheet in the channel. These features increase the cost and complexity of the construction and reduce its reliability and maintainability.

The above design can be also declined in a horizontal arrangement. Even if with this arrangement the problem of deposition on the tubesheet is avoided, the other drawbacks remain.

An alternative prior-art design of shell-and-tube waste heat boiler provides that water is circulated inside the tubes, but in this case an external steam drum for steam separation is always provided. The external steam drum and the relevant piping increase equipment costs, installation costs and space requirements.

Recovering heat from hot process streams is an important way of improving the overall energy efficiency of many chemical plants and processes. On the other hand, a high investment cost for a waste heat boiler or the risk of failure (e.g. due to corrosion) may discourage this energy recovery. The prior art does not provide a fully satisfactory solution, due to the above drawbacks of conventional waste heat boilers.

SUMMARY OF THE INVENTION

The invention provides a novel design for a waste heat boiler, which overcomes the above drawbacks of the prior art. The novel design combines the advantages of evaporation in the tube side and integrated separation of the vapour fraction without an external drum.

These aims are reached with a shell-and-tube apparatus comprising a vessel with an exchanging section and a separation section, wherein:

said exchanging section contains a bundle of U-tubes having respective tube inlet ends and tube outlet ends, and a hot chamber around said tubes, said hot chamber being in communication with an input for a hot process stream, said separating section comprises a collection chamber in communication with said outlet ends of tubes, said apparatus also comprises an input for an evaporable liquid medium, which is in communication with said tube inlet ends, so that, during operation, said tubes are exposed to said hot process stream while traversing said hot chamber, while the evaporable medium is heated and at least partially evaporated while flowing inside said tube, and the at least partially evaporated medium is admitted to said collection chamber after leaving the tubes, said separating section being also arranged to provide separation of vapour fraction and liquid fraction from said at least partially evaporated medium.

The separating section of the apparatus may be arranged to provide separation of vapour fraction from liquid fraction (for example steam from water) by means of gravity, possibly with the help of a suitable separator, which is preferably located in the top portion of the collection chamber. The separator for example may be a demister or a cyclone.

Preferably the separating section is arranged to provide that the steam separated by gravity has a purity of at least 98% in weight. More preferably said separating section is arranged to provide that steam separated by gravity has a purity of 99.5% in weight or greater. The purity of the steam may be further increased with suitable means, e.g. with a steam drier when appropriate.

Preferably, the apparatus comprises control means to keep a controlled liquid level in said collection chamber. Regulation of the liquid level may include controlled feed of fresh water and partial recycle of the non-evaporated liquid fraction. Accordingly, the apparatus may comprise corresponding means to detect the liquid level inside the collection chamber, and to regulate the amount of fresh liquid and the amount of recycled liquid admitted to the tubes.

The liquid level in the collection chamber may be regulated lo leave a suitable free volume above the liquid level. Said free volume is determined for example to allow separation of the vapour fraction (or at least of a relevant portion thereof) by gravity. The liquid level may also be regulated to provide a sufficient pressure for natural circulation of recycled non-evaporated liquid fraction. The boiler feed pressure may also be used to facilitate recirculation.

Recycle of non-evaporated liquid fraction may be driven by gravity or, in some embodiments, by one or more circulating devices such as pumps or ejectors. The mixing of recycled non-evaporated liquid fraction with the fresh liquid may be effected inside or outside the apparatus. Part of the non-evaporated liquid is preferably withdrawn from the collection chamber to maintain a desired degree of purity.

The apparatus may be arranged vertically or horizontally, according to various embodiments of the invention.

In a vertical arrangement, the separation section is preferably above the exchanging section.

In a vertical arrangement, the bundle of U-tubes preferably faces downward. According to this preferred embodiment, each tube has a first straight portion starting from the inlet end, where the evaporable medium flows downward, a second straight portion where said medium flows upwards until it reaches the outlet end of the tube, and a U-shaped portion to connect said first and second straight portions.

In a horizontal arrangement, the bundle of U-tubes is horizontal and preferably has the inlet section in the lower part. Accordingly, each tube has a first lower straight portion starting from the inlet end, where the evaporable medium flows toward the U-shaped portion, which connect said first lower portion to the second upper straight portions where said medium flows until it reaches the outlet end of the tube.

In most embodiments, the evaporable medium is water, which is partially converted into steam to recover heat. Hence the following detailed description will be made with reference to water/steam.

The invention has the following main advantages: since evaporation of the liquid takes place in the tube side, dead spots and related risk of deposition of suspended solids are reduced. All tubes are homogeneously fed and heated, therefore there is no area where the above mentioned phenomenon of dry out may occur. Separation of the vapour fraction in the collection chamber avoids the need of an external separator, thus reducing the overall cost. The above mentioned risk of overheating of the first part of tubes inside the tubesheet is also avoided, The features and advantages of the present invention shall be more evident from the description, hereinafter provided for exemplifying and non-limiting purposes, with reference to the attached drawings.

DETAILED DESCRIPTION OF A PREFERRED EMBODIMENT

Figure 1:
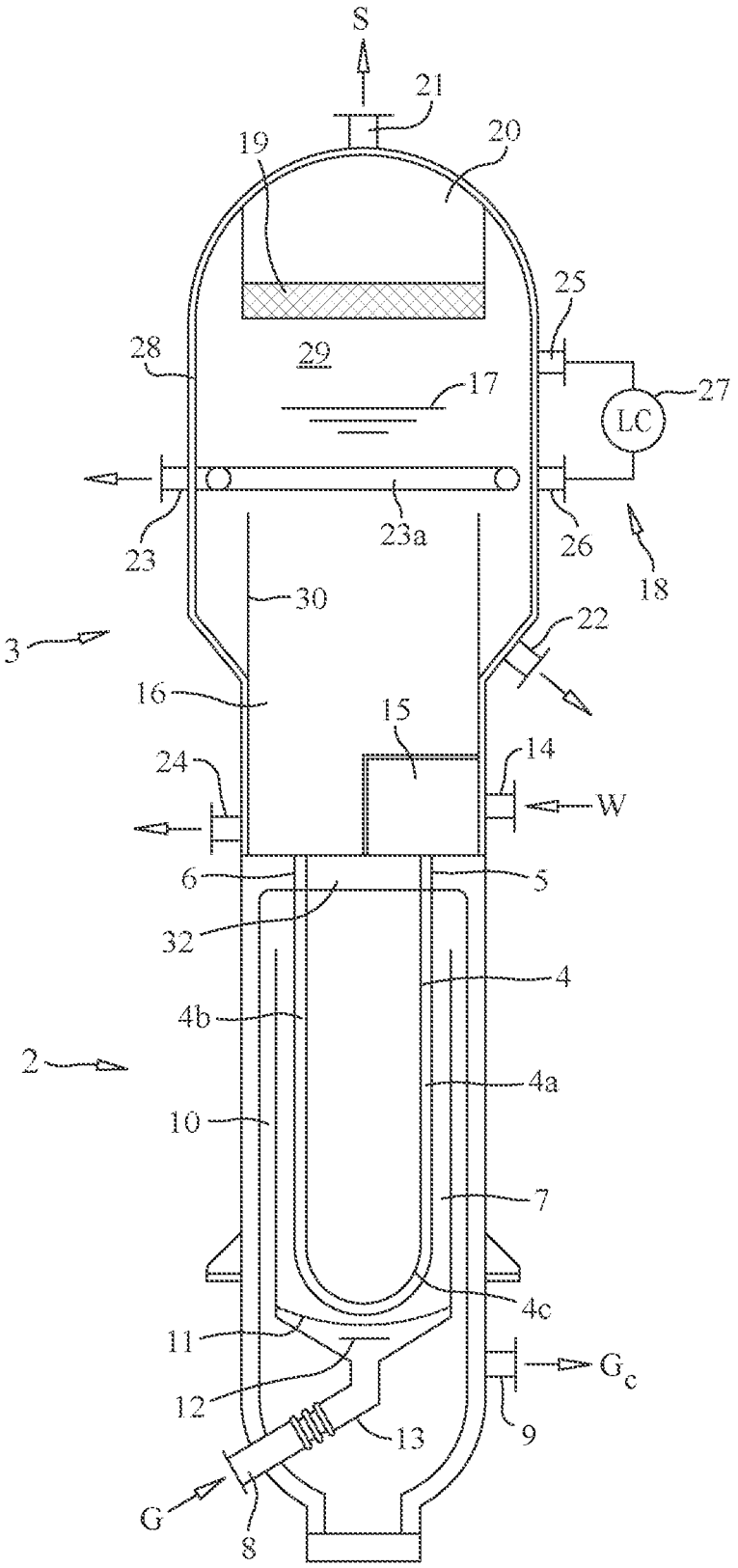
FIG. 1 is a schematic section of a vertical shell-and-tube apparatus according to an embodiment of the invention.

FIG. 1 shows a vertical shell-and-tube waste heat boiler 1 according to a preferred embodiment of the invention.

The boiler 1 is designed to recover heat from a hot gas G by heating and evaporating a water feed W, thus producing steam S at a suitable pressure.

Said boiler 1 basically comprises a lower exchanging section 2 embodying a shell-and-tube heat exchanger, and an upper separating section 3 to receive a mixed steam water effluent from the tubes, and designed to separate steam from non-evaporated water.

More in detail, the lower section 2 contains a bundle of tubes 4 having respective tube inlet ends 5 and tube outlet ends 6, and a hot chamber 7 around said tubes 4. This lower section 2 operates substantially as a shell-and-tube heat exchanger, where tubes are fed with the water W and the shell side, namely the hot chamber 7, is traversed by the hot gas G.

The bundle of tubes is shown in a schematic manner. Each tube 4 is a U-tube having: a first straight portion 4*a*, a second straight portion 4*b*, and a U-shaped portion 4*c* to connect said straight portions. The tubes are supported by a tubesheet 32.

According to a preferred embodiment of the invention, in the vertical arrangement (FIG. 1) the tubes face downward in the vertical boiler, i.e. the U-shaped connection 4*c* is located at the bottom of the vertical bundle.

The hot chamber 7 is in communication with an inlet 8 for the hot gas G. Said gas G may be for example the product of a combustion, reforming, or exothermal chemical reaction.

A gas outlet 9 for the cooled gas Gc is also in communication with the hot chamber 7. The cooled gas leaves the chamber 7 via an annular region 10 around said chamber 7. FIG. 1 also shows a distributor 11 and an impingement plate 12 for the hot gas G, and a duct 13 for admission of the hot gas G into the chamber 7.

The inlet ends 5 of tubes 4 are in communication with an inlet 14 for the fresh water feed W, via a feeding chamber 15. The fresh water W, in some embodiments, may be mixed with a suitable amount of non-evaporated water recycled from the separating section 3, before it enters the tubes 4.

The separating section 3 of the boiler 1 comprises a collection chamber 16 connected to the bundle of tubes 4, and said chamber 16 is in communication with the outlet ends 6 of the tubes 4, to receive the mixed water/steam effluent from said tubes. Hence, the collection chamber 16 normally contains a certain amount of water during operation. The liquid level inside said chamber 16 is denoted by reference 17. Reference 29 denotes the free space over the liquid level 17.

The liquid level 17 is controlled by means of a controller 18. A suitable liquid level in the chamber 16 is maintained to facilitate steam separation by gravity, thus leaving a sufficient free space 29 for the disengagement of steam from water.

The separating section 3 of the boiler 1 may be further equipped with a suitable vapour/liquid separator. In the shown embodiment, the boiler 1 comprises a steam drier 19 which is located in the top part of the upper section 3, thus defining a steam chamber 20 above the collection chamber 16 and in communication with a steam outlet 21.

Non-evaporated water leaves the collection chamber 16 via a main outlet 22 and further outlets 23, 24 which are used to withdraw suitable amounts of water (water blow-down), in order to avoid accumulation of water-suspended solids in the collection chamber 16. In particular, the outlet 23 is connected to a pipe 23*a* and is used for continuous blow-down while the outlet 24 is preferably used, when necessary, for a discontinuous blow-down.

The level regulator 18 essentially comprises two pressure gauges 25, 26 and a control unit 27 to determine the liquid level 17 as a function of the differential pressure between said gauges. Then, the level 17 is preferably regulated by controlling the flow rate of the fresh water W admitted to the tubes 4 and the amount of recycled water taken from the chamber 16.

Recycle of non-evaporated water may be internal or external to the boiler 1. For example, internal recycle may be effected by feeding an amount of non-evaporated water to the water chamber 15; external recycle may be effected by mixing a portion of the water from outlet 22 with the fresh water feed W before admission to the inlet 14 of the boiler 1, The boiler 1 may comprise means such as pumps or ejectors for recirculation of water, which are not shown in FIG. 1 for the sake of simplicity.

The shown embodiment provides also that the collection chamber 16 has a first portion delimited by an internal wall 30, and a second portion delimited by a dome 28 of a greater diameter compared to the rest of the shell.

Figure 2:
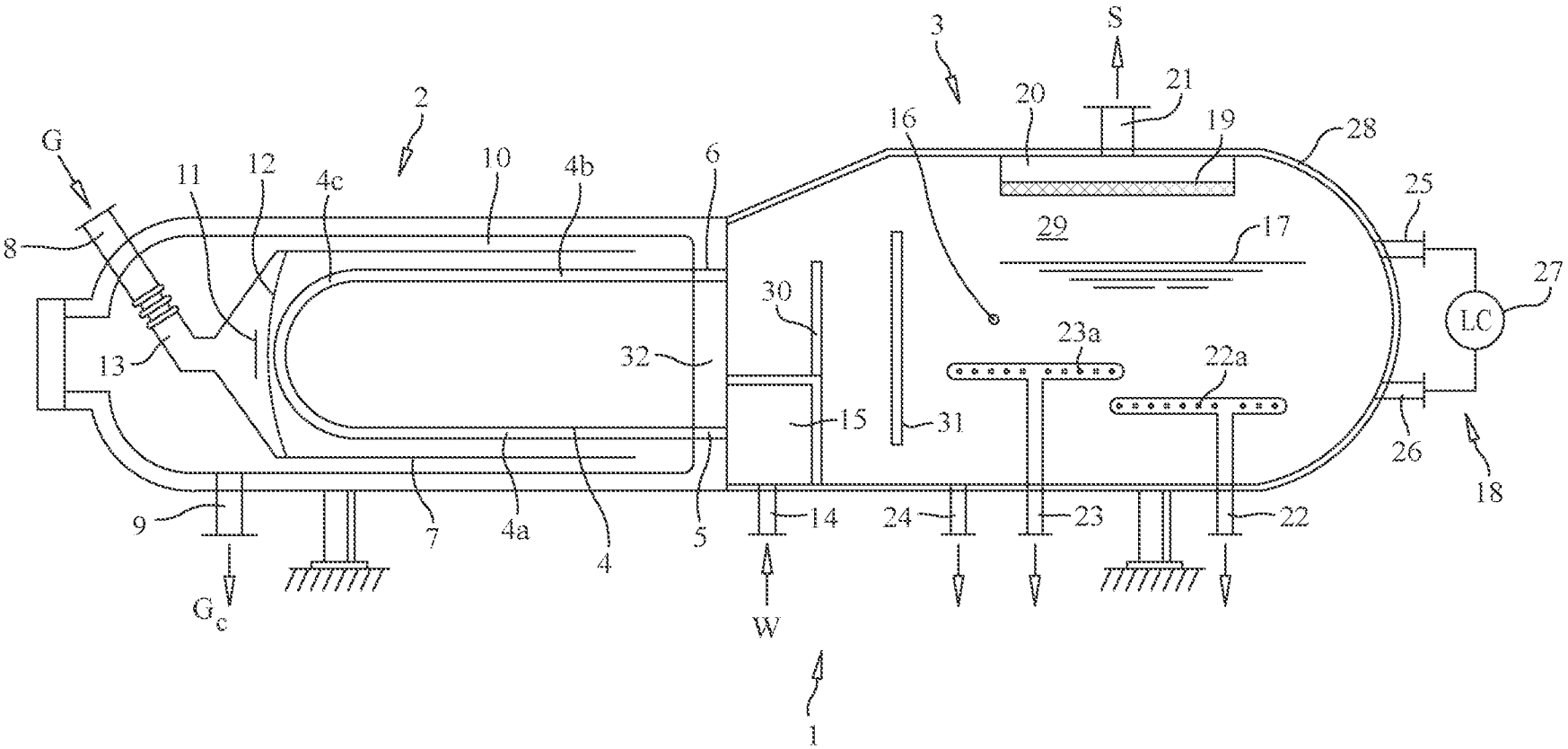
FIG. 2 is a schematic section of a horizontal shell-and-tube apparatus according to another embodiment of the invention.

FIG. 2 shows an example of horizontal embodiment. The items corresponding to those of FIG. 1 are denoted in FIG. 2 with the same reference numbers, for simplicity. Hence, they are not described in a full detail and reference can be made to the above description of FIG. 1.

It can be seen that the horizontal exchanger of FIG. 2 comprises an exchanging section 2 and a separating section 3 arranged side by side.

The exchanging section 2 comprises a horizontal bundle of U-tubes 4. The figure shows an embodiment where the inlet straight potion 4*a* of the tubes 4 is on the lower part of the bundle, while the outlet straight portion 4*b* is in the upper part of the bundle.

The separating section 3 comprises basically a collection chamber 16 to receive the partially evaporated effluent from tubes 4, a steam drier 19, a level regulator 18 to control the water level 17, a steam outlet 21 in communication with a steam chamber 20, a main water outlet 22, blow-down water outlets 23, 24. In the shown embodiment, also the outlet 22 has a water collector 22*a*.

The collection chamber 16 has a first portion delimited by internal walls 30, 31, and a second portion delimited by a larger portion of shell 28.

The operation is as follows. The exchanging section 2 operates as a shell-and-tube evaporator, where water is heated and partially evaporated in the tubes 4 by means of the heat exchanged with the hot gas G traversing the hot chamber 7 in contact with the outside surface of tubes 4.

The mixed steam/water flow leaves the tubes 4 and enters the collection chamber 16 in the separating section 3 of the boiler. In the space 29 above the liquid level 17, steam separates by gravity and is further purified by passage through the steam drier 19, so that a dry steam, substantially free of water, is obtained at the steam outlet 21.

Non-evaporated water is discharged by means of outlet 22. A portion of said non-evaporated water may be recycled and directed again to the tubes 4 together with the fresh water W, as explained before.

It can be appreciated that the waste heat boiler meets the aims of the invention. Compared with a prior-art boiler with integrated steam drum and water evaporation on the shell side, the advantages of the proposed design is that the water is on the tube side and, therefore, there are no dead spots where deposit of suspended solids is likely to occur. All tubes 4 are homogeneously fed and heated therefore there are not areas where dry out may occur. Recirculation water to feed the tubes can be taken at a high level as in a separate steam drum, avoiding solids which concentrate near the bottom. Fresh feed water can be mixed with the recirculating water feeding the tubes effectively assuring that boiling water does not carry an excessive concentration of solids. For these reasons, corrosion is avoided and also the deterioration of the heat transfer capabilities and the overheating due to solid deposit on the heat transfer surface are greatly reduced. Moreover the portion of tubes inside the tubesheet 32 is not heated by the hot gas and therefore all the portions of tubes exposed to the hot gas are cooled by the boiling water inside the tubes.

Compared with a conventional boiler with evaporation in the tube side, the advantage of this system is that the steam is separated inside the boiler without the need for external separation equipment and related piping.

The invention claimed is:

1. A shell-and-tube apparatus comprising a vessel with an exchanging section and a separating section within said vessel, wherein said exchanging section contains a bundle of U-tubes having respective tube inlet ends and tube outlet ends, and a chamber around said tubes, said chamber being in communication with an input for a process stream, said separating section comprises a collection chamber in communication with said outlet ends of the tubes;

wherein said apparatus has an input for an evaporable liquid medium and a chamber within said vessel for receiving said evaporable liquid medium through said input, which is in communication with said tube inlet ends;

wherein said evaporable liquid medium has a temperature, which is lower than the temperature of said process stream so that, during operation, said tubes are exposed to said process stream while the process stream traverses said chamber around said tubes, and the evaporable medium is heated and at least partially evaporated by flowing inside said tubes, and the at least partially evaporated medium is admitted to said collection chamber after leaving said tubes;

wherein in said separating section, vapour fraction and liquid fraction separate from said at least partially evaporated medium;

wherein said chamber for receiving said evaporable liquid medium is not part of said separating section;

wherein no separation of vapour takes place in said chamber for receiving said evaporable liquid medium;

wherein each tube has a first straight portion starting from the inlet end, where the evaporable medium flows downward, a second straight portion where said medium flows upwards until it reaches the outlet end of the tube, and a U-shaped portion that connects said straight portions;

wherein the vessel comprises an outlet for non-evaporated liquid medium; and wherein the apparatus is configured to mix, externally to the vessel, a portion of non-evaporated liquid medium extracted from the outlet for non-evaporated liquid medium with the evaporable liquid medium fed to said input for evaporable liquid medium.

2. The apparatus according to claim 1, wherein in said separating section separation of vapour takes place at least partially by gravity.

3. The apparatus according to claim 1, comprising control means for maintenance of a controlled liquid level in said collection chamber.

4. The apparatus according to claim 3, wherein said control means is operable in such a way to maintain a volume inside the collection chamber and above a liquid level which is sufficient to allow separation of a vapour fraction by gravity.

5. The apparatus according to claim 1, wherein said separating section of the vessel also comprises means for separation of vapour fraction from the liquid fraction.

6. The apparatus according to claim 5, wherein said means includes a demister or a cyclone.

7. The apparatus according to claim 1, wherein the apparatus is horizontally arranged.

8. The apparatus according to claim 7, wherein the bundle of U-tubes is horizontal and each tube has an inlet straight portion which is on a lower part of the bundle, and an outlet straight portion which is in an upper part of the bundle.

9. The apparatus according to claim 1, wherein said evaporable medium is water.

10. The apparatus according to claim 3, wherein said separating section produces steam having purity of at least 98% in weight.

11. The apparatus according to claim 10, wherein said steam has a purity of at least 99.5% in weight.

* * * * *